US012208303B2

(12) United States Patent
Leavitt et al.

(10) Patent No.: US 12,208,303 B2
(45) Date of Patent: Jan. 28, 2025

(54) MULTI-FUNCTION EXERCISE APPARATUS

(71) Applicant: THROWDOWN INDUSTRIES HOLDINGS, LLC, Lake Forest, CA (US)

(72) Inventors: Jeremy Leavitt, Bayfield, CO (US); Charles Joiner, Orem, UT (US)

(73) Assignee: THROWDOWN INDUSTRIES HOLDINGS, LLC, Lake Forest, CA (US)

( * ) Notice: Subject to any disclaimer, the term of this patent is extended or adjusted under 35 U.S.C. 154(b) by 348 days.

(21) Appl. No.: 17/648,476

(22) Filed: Jan. 20, 2022

(65) Prior Publication Data

US 2022/0233910 A1 Jul. 28, 2022

Related U.S. Application Data

(60) Provisional application No. 63/199,762, filed on Jan. 22, 2021.

(51) Int. Cl.
*A63B 21/00* (2006.01)
*A63B 71/00* (2006.01)

(52) U.S. Cl.
CPC ..... *A63B 21/4029* (2015.10); *A63B 21/4035* (2015.10); *A63B 71/0036* (2013.01); *A63B 2210/50* (2013.01); *A63B 2225/09* (2013.01)

(58) Field of Classification Search
CPC ..... A63B 21/4029
See application file for complete search history.

(56) References Cited

U.S. PATENT DOCUMENTS 3,145,646 A 8/1964 Levy
4,564,194 A * 1/1986 Dawson ..... A63B 21/0626 482/102

(Continued)

FOREIGN PATENT DOCUMENTS

CA 2343559 A1 10/2002

OTHER PUBLICATIONS

Dumbbell Bench (n.d.). Retrieved Feb. 4, 2021, from:"https://www.walmart.com/ip/Multifunctional-Foldable-Dumbbell-Bench-7-Gears-Backrest-2-Hook-Foot-Foam-Sit-Up-AB-Abdominal-Training-Sports-Workout-Indoor-Home-Gym-Max-Load-Weight/938640936?wmlspartner=wlpa&selectedSellerId=101012893&&adid=2222222" (Year: 2021).*

(Continued)

*Primary Examiner* — Nyca T Nguyen
(74) *Attorney, Agent, or Firm* — FOLEY & LARDNER LLP

(57) ABSTRACT

A multi-function exercise apparatus for conducting an exercise regimen with a single exercise apparatus is disclosed. The apparatus may be readily reoriented via a selectively extensible caster and wheels to face a desired direction for performance of an exercise. The multi-function exercise apparatus may be provisioned with storage locations to maintain weights and other accessories with the apparatus, to equip the multi-function exercise with the necessary weights and accessories for performing a full body exercise regimen. An articulating frame assembly permits a cushion assembly to be raised in either of a partial tilting configuration and a full tilting configuration. In the partial tilting configuration, a seated exercise apparatus is provided. In the full tilting configuration, a full cushioned surface of the apparatus may be tilted to a desired vertical orientation for performance of other exercises with the apparatus.

17 Claims, 7 Drawing Sheets

(56) References Cited

U.S. PATENT DOCUMENTS 4,691,918 A 9/1987 Rockwell
4,728,101 A 3/1988 King
4,826,157 A 5/1989 Fitzpatrick
4,871,166 A 10/1989 Sterba et al.
4,919,419 A * 4/1990 Houston ..... A63B 21/078 482/138
5,042,801 A 8/1991 Sterba et al.
5,232,426 A 8/1993 Van Straaten
5,518,487 A 5/1996 Hallmark
5,575,742 A 11/1996 Wu
5,626,546 A 5/1997 Little
5,637,059 A 6/1997 Dalebout
5,665,038 A 9/1997 Miller
5,725,460 A 3/1998 Marsh
5,997,442 A 12/1999 Cordes
D423,237 S 4/2000 Chang
D425,950 S 5/2000 Ceppo
6,245,001 B1 6/2001 Siaperas
6,264,586 B1 7/2001 Webber
6,350,221 B1 2/2002 Krull
6,454,683 B1 9/2002 Kaye
6,471,624 B1 10/2002 Voris
D468,915 S 1/2003 Talbott et al.
6,634,998 B2 * 10/2003 Siaperas ..... A63B 21/04 482/142
6,645,130 B2 * 11/2003 Webber ..... A63B 21/4029 482/133
6,908,417 B2 * 6/2005 Jackson ..... A63B 21/0552 482/52
D542,867 S 5/2007 Teruo
D547,400 S 7/2007 Rogers et al.
7,338,416 B2 * 3/2008 Smith ..... A63B 21/078 482/106
D565,673 S 4/2008 Lien et al.
7,465,260 B2 12/2008 Hockemeyer
7,601,101 B2 * 10/2009 Jackson ..... A63B 21/0552 482/52
D604,373 S 11/2009 Dalebout et al.
7,614,988 B1 * 11/2009 Kiser ..... A47C 11/00 482/142
7,651,452 B2 * 1/2010 Weir ..... A63B 21/078 482/52
7,654,944 B1 2/2010 Liu
7,674,215 B1 3/2010 Swanson et al.
7,731,639 B1 6/2010 Shifferaw
D627,013 S 11/2010 Nys
8,506,462 B2 8/2013 Gregor et al.
D690,142 S 9/2013 Arko et al.
8,858,409 B2 10/2014 Trees
D726,425 S 4/2015 Chen
9,125,785 B2 9/2015 Trees
D754,266 S 4/2016 Ross
9,517,375 B2 12/2016 Lagree
9,713,735 B2 7/2017 Lanfranco
9,764,751 B2 9/2017 Cho
9,770,618 B2 * 9/2017 Wall ..... A63B 21/0557
D807,444 S 1/2018 Januszek
9,878,201 B1 * 1/2018 Moschel ..... A63B 23/03575
D831,762 S 10/2018 Donnelly et al.
10,092,791 B2 * 10/2018 Donnelly ..... A63B 21/0726
D834,339 S 11/2018 Silver
10,226,662 B1 3/2019 Mink
10,300,328 B2 5/2019 Lagree et al.
D871,528 S 12/2019 Donnelly et al.
10,576,352 B2 * 3/2020 Vester ..... A63B 21/4029
10,589,144 B2 * 3/2020 Specht ..... A63B 21/4029
10,675,499 B2 6/2020 Vorozilchak et al.
10,779,645 B2 * 9/2020 Siaperas ..... A63B 21/4033
10,960,256 B2 * 3/2021 Donnelly ..... A63B 21/4029
11,700,947 B1 * 7/2023 Rodriguez ..... A47C 13/00 297/118
2001/0018387 A1 8/2001 Webber
2001/0027151 A1 * 10/2001 Siaperas ..... A63B 21/04 482/121
2004/0018923 A1 * 1/2004 Schiff ..... A63B 21/4029 482/142
2005/0148449 A1 7/2005 Weir et al.
2005/0197238 A1 * 9/2005 Parker ..... A63B 21/4029 482/142
2006/0052220 A1 3/2006 Jackson et al.
2006/0122045 A1 6/2006 Webber
2007/0087920 A1 4/2007 Dachraoui et al.
2007/0099780 A1 5/2007 Bowser
2007/0129225 A1 6/2007 Hammer
2007/0155604 A1 7/2007 Hockemeyer
2007/0219072 A1 9/2007 Kessler
2007/0270292 A1 * 11/2007 Laney ..... A63B 22/0605 482/121
2008/0076641 A1 3/2008 Sheehan
2009/0062086 A1 3/2009 Dalebout et al.
2009/0143203 A1 * 6/2009 Knapp ..... A63B 23/0355 482/104
2009/0174162 A1 7/2009 Gass et al.
2009/0203505 A1 8/2009 Kroll et al.
2016/0059104 A1 3/2016 Monaco
2017/0100622 A1 * 4/2017 Wall ..... A63B 21/4029
2017/0144684 A1 5/2017 Cho
2017/0239512 A1 * 8/2017 Brasch ..... A63B 21/4029
2018/0236298 A1 8/2018 Donnelly et al.
2019/0126122 A1 5/2019 Vester
2019/0151699 A1 * 5/2019 Isom ..... A63B 21/00061
2019/0166993 A1 * 6/2019 Siaperas ..... A47B 81/00
2019/0240528 A1 * 8/2019 Donnelly ..... A63B 21/4029
2020/0101346 A1 * 4/2020 Chen ..... A63B 21/4029
2020/0215408 A1 7/2020 Vester
2023/0166151 A1 * 6/2023 Susko ..... A63B 21/078 482/142

OTHER PUBLICATIONS

Continue from above link "2227375251293&wl0=&wl1=g&wl2=c&wl3=472974653689&wl4=aud-430887228898:pla-980601507513&wl5=9007575&wl6=&wl7=&wl8=&wl9=pla&wl10=144521308&wl11=online&wl12=938640936&veh=sem&gclid=CjOKCQjwit_ 8BRCoARIsAlx3Rj4MU4Dvg9ggy21Y8YBOgm9Q4EHYQis0SMuQE16BmC6Kzy-VanckQElaAgBsEALw_wcB" (Year: 2021).*

International Search Report and Written Opinion; PCT/US2022/013114; mailed May 4, 2022.

Bench Pro (n.d.). Retrieved Feb. 4, 2021, from https://zenogym.com/collections/benches/products/zeno-bench-pro.

5.1S Stowable Bench (n.d.). Retrieved Feb. 4, 2021, from https://www.bestbuy.com/site/bowflex-5-1s-stowable-bench-black/6405087.p?skuId=6405087&irclickid=2iT3SzxpuxyLWPN0MKVSfWfHUkEx8-0R33LcVw0&irgwc=1&ref=198&loc=Skimbit%20Ltd.&acampID=0&mpid=10078.

Fitness Deck (n.d.). Retrieved Feb. 4, 2021, from https://www.amazon.com/dp/B07K8XNQDC?linkCode=ogi&tag=menshealth-auto-20&ascsubtag=%5bartid|2139.g.23011949%5bsrc|%5bch|%5blt|.

Pro-Workout Bench (n.d.). Retrieved Feb. 4, 2021, from https://www.pwbfit.com/store/p10/Pro-WorkoutBench-with-ResistanceBands.html.

Weight Bench (n.d.). Retrieved Feb. 4, 2021, from https://www.amazon.com/Adjustable-Incline-Extension-black%EF%BC%88Maximum-Load%EF%BC%9A300lb%EF%BC%89/dp/B08DQX7YY5/ref=asc_df_B08DQX7YY5/?tag=hyprod-20&linkCode=df0&hvadid=459576457808&hvpos=&hvnetw=g&hvrand=15396363424612694 78&hvpone=&hvptwo=&hvqmt=&hvdev=c&hvdvcmdl=&hvlocint=&hvlocphy=9007575&hvtargid=pla-945433402765&psc=1.

Sit Up Bench (n.d.). Retrieved Feb. 4, 2021, from https://www.amazon.com/YINGLONG-Dumbbells-Strength-Abdominal-Activities/dp/B08JQ3XPDV/ref=asc_df_B08JQ3XPDV/?tag=hyprod-20&linkCode=df0&hvadid=459505522012&hvpos=&hvnetw=g&hvrand=15396363424612694 78&hvpone=&hvptwo=&hvqmt=&hvdev=c&hvdvcmdl=&hvlocint=&hvlocphy=9007575&hvtargid=pla-1003282774924&psc=1.

(56) References Cited

OTHER PUBLICATIONS

Adjustable Weight Bench (n.d.). Retrieved Feb. 4, 2021, from https://www.amazon.com/dp/B083VXGP14?linkCode=ogi&tag=menshealth-auto-20&ascsubtag=%5bartid|2139.g.23011949%5bsrc|%5bch|%5blt|.

Adjustable FID Weight Bench (n.d.). Retrieved Feb. 4, 2021, from https://www.amazon.com/dp/B004XCLH6M?linkCode=ogi&tag=menshealth-auto-20&ascsubtag=%5bartid|2139.g.23011949%5bsrc|%5bch|%5blt|.

Flat Incline Adjustable Rugged Weight Bench (n.d.). Retrieved Feb. 4, 2021, from https://www.amazon.com/dp/B004XCLH6M?linkCode=ogi&tag=menshealth-auto-20&ascsubtag=%5bartid|2139.g.23011949%5bsrc|%5bch|%5blt|.

Adjustable Flat Incline Weight Bench (n.d.). Retrieved Feb. 4, 2021, from https://www.amazon.com/dp/801M5G2PND?

Flat Weight Bench with Handle and Wheels (n.d.). Retrieved Feb. 4, 2021, from https://www.amazon.com/TITAN-FITNESS-Weight-Handle-Supports/dp/B01M31YT3M.

Strongbox (n.d.). Retrieved Feb. 4, 2021, from https://escapefitness.com/us/product-range/strongbox?__store=us.

Adjustable/Foldable Utility Weight Bench (n.d.). Retrieved Feb. 4, 2021, from https://www.amazon.com/RitFit-Adjustable-Foldable-Weightlifting-Strength/dp/B07KVYGXR2/ref=sr_1_26?dchild=1&keywords=weight+bench+pads&qid=1603761592&sr=8-26.

Adjustable Weight Bench (n.d.). Retrieved Feb. 4, 2021, from https://www.amazon.com/PASYOU-Adjustable-Workout-Foldable-Exercise/dp/B07S7NRZL4.

Floor Lock (n.d.). Retrieved Feb. 4, 2021, from https://www.zoro.com/zoro-select-floor-lock-plate-6-78-in-h-4-x-4-12-16v372/i/G4392604/.

Multi-Functional Bench (n.d.). Retrieved Feb. 4, 2021, from https://finerform.com/products/roman-chair-and-hyperextension bench?variant=11073927610404&currency=USD&utm_medium=product_sync&utm_source=google&utm_content=sag_organic&utm_campaign=sag_organic&gclid=Cj0KCQjwit_8BRCoARIsAIx3Rj5ADHUqEthKtHR12aE_wgnZPFOaorZORkJeTJWGaHATii0pLKKbDMgaAulmEALw_wcB.

* cited by examiner

MULTI-FUNCTION EXERCISE APPARATUS

CROSS-REFERENCE TO RELATED APPLICATION

This application claims the benefit of priority of U.S. provisional application No. 63/199,762 filed Jan. 22, 2021, the contents of which are herein incorporated by reference.

BACKGROUND OF THE INVENTION

The present invention relates to exercise apparatus, and more particularly to exercise apparatus for performing multiple exercises.

For fitness centers and even home gym enthusiasts, fitness equipment has been limited in the number of exercises that can be performed with a given apparatus. This can lead to an excessive number of apparatus in a gym so that the user can exercise all targeted muscle groups.

In the fitness center context, this can present delays for users who may need to wait on another user that may be targeting a specific muscle group during a given exercise period. In the pandemic environment, the availability of the shared apparatus may be further delayed by the need to sanitize the apparatus between users. Likewise, it has become increasingly popular for guided fitness sessions to be led by a fitness instructor, often with several participants in the class.

For guided instruction, it is desirable for each participant to have their own apparatus, to avoid time delays for participant circulation between apparatus and sanitizing apparatus between transitions from one apparatus to the next. Moreover, it is also desirable for each participant be able to view the instructor during the exercise to assist in maintaining proper form for conducting the exercise and/or keeping pace with the guided instruction. In the case of a home gym, the user may have mirrors within the gym to facilitate maintenance of proper form during an exercise routine.

It is also desirable for each apparatus to be able to carry its own weights and fitness accessories for the performance a given exercise regimen, rather than having these items retained at one or more centralized locations at the fitness center.

Conventional exercise apparatus do not meet these needs as they are limited in the number of exercises that can be performed on the apparatus and they are not designed to be easily reoriented in a desired direction, such as facing an instructor or a mirror.

As can be seen, there is a need for improved fitness apparatus that provides a single apparatus for performing multiple fitness regimens while permitting the user to easily reorient the apparatus in a desired direction.

SUMMARY OF THE INVENTION

In one aspect of the present invention, a multi-function exercise apparatus is disclosed. The multi-function exercise apparatus includes a base assembly supporting an articulating frame assembly. The articulating frame assembly includes an exterior frame element pivotally coupled to a first end of the base assembly. The exterior frame element is operable for a full tilting configuration of the multi-function exercise apparatus. An interior frame element is pivotally coupled to the exterior frame element. The interior frame element is operable for a partial tilting configuration of the multi-function exercise apparatus. A cushion assembly is carried on the articulating frame assembly.

In some embodiments, the cushion assembly is maintained in a linear alignment with the exterior frame element. In the partial tilting configuration, a first cushion of the cushion assembly is maintained in a flat condition with the exterior frame element, defining a seat. At least one other cushion of the cushion assembly is carried by the interior frame element, defining a backrest when raised in the partial tilting configuration.

In some embodiments, the exterior frame element is movable in a first arc in the full tilting configuration and the interior frame element is movable in a second arc, opposite the first arc, when operated in the partial tilting configuration.

In some embodiments, a first support arm has a first end and a second end. The first end of the first support arm is pivotally coupled to the interior frame element. The second end of the first support arm engageable with a first plurality of indexed engagement points defined in a spaced apart relation across a top surface of the base assembly. When engaged with a selected one of the first plurality of indexed engagement points, the interior frame element is supported at a selected partial tilting angle relative to the exterior frame element.

In some embodiments, a second support arm has a first end and a second end. The first end of the second support arm pivotally coupled to the exterior frame element. The second end of the second support arm is engageable with a second plurality of indexed engagement points defined in a spaced apart relation along a top rail of the base assembly. When engaged with a selected one of the second plurality of indexed engagement points, the exterior frame element is supported at a selected full tilting angle relative to the base assembly.

In some embodiments, a pair of feet are attached to a front end of the base assembly. A pair of wheels attached to a rear end of the base assembly, opposite the pair of feet. A caster assembly is mechanically coupled to the front end of the base assembly. The caster assembly is operable to selectively position the caster assembly between a raised position and a lowered position. In the lowered position, the base assembly is movable on the pair of wheels and the caster assembly. In the raised position, the base assembly is supported by the pair of feet.

In some embodiments, a handle disposed at the front end of the base assembly. A plurality of linkages interconnect the handle with the caster assembly. Operation of the handle positions the caster assembly between the raised position and the lowered position. Preferably, a lifting of the handle operates the caster assembly to the lowered position.

In other aspects of the invention, a multi-function exercise apparatus is disclosed. The multi-function exercise apparatus includes a base assembly. An exterior frame element is pivotally coupled to a front end of the base assembly. The exterior frame element is operable for a full tilting configuration of the multi-function exercise apparatus. An interior frame element is pivotally coupled to the exterior frame element. The interior frame element is operable for a partial tilting configuration of the multi-function exercise apparatus. At least one cushion of a cushion assembly is carried on each of the exterior frame element and the interior frame element.

In some embodiments, a caster assembly is mechanically coupled to a front end of the base assembly. A pair of wheels are attached to a second end of the base assembly. The caster assembly is operable to selectively position the base assembly between a lowered position and a raised position. In the raised position, the base assembly is movable on the pair of wheels and the caster assembly.

In some embodiments, a handle is coupled at the front end of the base assembly. A plurality of linkages interconnect the handle with the caster assembly. Operation of the handle positions the caster assembly to move the base assembly between the raised position and the lowered position. Preferably, a lifting of the handle operates the caster assembly to support the base assembly in the raised position.

In some embodiments, when in the partial tilting configuration, a first cushion of the cushion assembly is maintained in a flat condition with the exterior frame element, defining a seat, and at least one other cushion of the cushion assembly is carried by the interior frame element, defining a backrest when raised in the partial tilting configuration.

In some embodiments, the exterior frame element is movable in a first arc when operated in the full tilting configuration and the interior frame element is movable in a second arc, opposite the first arc, when operated in the partial tilting configuration.

In some embodiments, a first support arm has a first end and a second end. The first end of the first support arm is pivotally coupled to the interior frame element. The second end of the first support arm is engageable with a first plurality of indexed engagement points defined in a spaced apart relation across a top surface of the base assembly. A second support arm has a first end and a second end. The first end of the second support arm is pivotally coupled to the exterior frame element. The second end of the second support arm is engageable with a second plurality of indexed engagement points defined in a spaced apart relation along a top rail of the base assembly.

When engaged with a selected one of the first plurality of indexed engagement points, the interior frame element is supported at a selected partial tilting angle relative to the exterior frame element. When engaged with a selected one of the second plurality of indexed engagement points, the exterior frame element is supported at a selected full tilting angle relative to the base assembly.

In yet other aspects of the invention, a multi-function exercise apparatus is disclosed. The multi-function exercise apparatus includes a base assembly. An exterior frame element is pivotally coupled to a first end of the base assembly. The the exterior frame element is operable for a full tilting configuration of the multi-function exercise apparatus about a first arc. An interior frame element is pivotally coupled to the exterior frame element. The interior frame element is operable for a partial tilting configuration of the multi-function exercise apparatus about a second arc opposite the first arc. The first cushion is carried on the exterior frame element and at least one second cushion carried on the interior frame element. A first support arm has a first end and a second end. The first end of the first support arm is pivotally coupled to the interior frame element. The second end of the first support arm is engageable with a first plurality of indexed engagement points defined in a spaced apart relation across a top of the base assembly. A second support arm has a first end and a second end. The first end of the second support arm is pivotally coupled to the exterior frame element. The second end of the second support arm is engageable with a second plurality of indexed engagement points defined in a spaced apart relation along a top rail of the base assembly.

These and other features, aspects and advantages of the present invention will become better understood with reference to the following drawings, description and claims.

DETAILED DESCRIPTION

Figure 1:
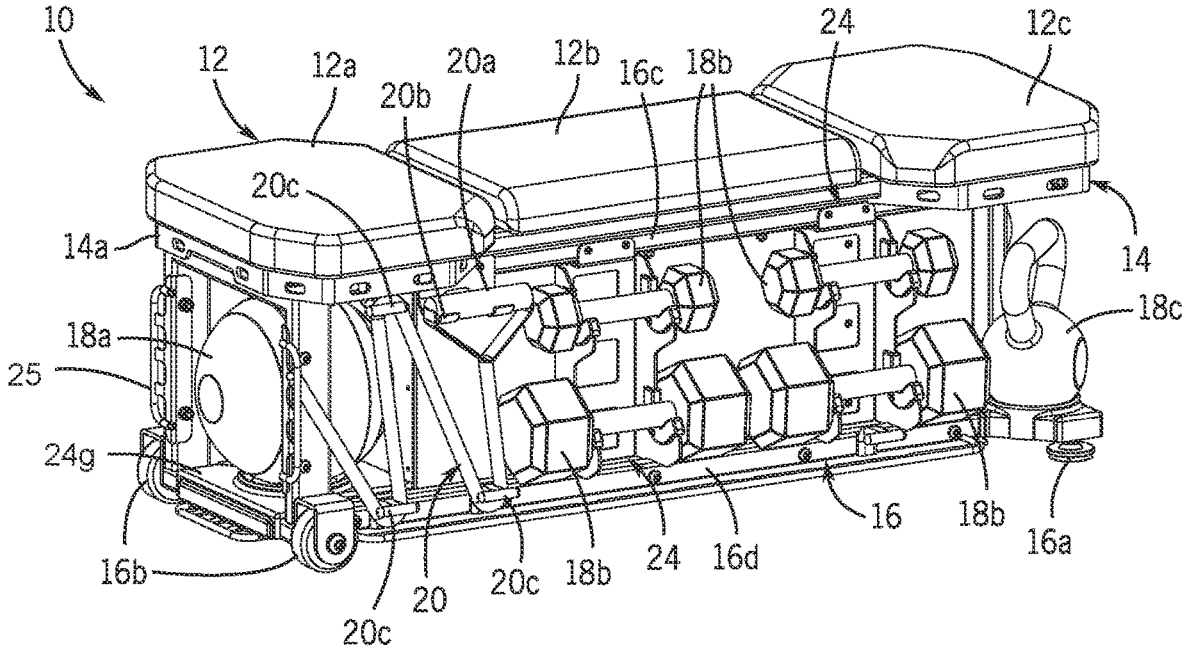
FIG. 1 is a front perspective view of the multi-function exercise apparatus showing the cushion in the flat position.

The following detailed description is of the best currently contemplated modes of carrying out exemplary embodiments of the invention. The description is not to be taken in a limiting sense but is made merely for the purpose of illustrating the general principles of the invention.

Broadly, embodiments of the present invention provide a multi-function exercise apparatus and method for conducting an exercise regimen with a single exercise apparatus that may be readily reoriented to face a desired direction for performance of an exercise. Each multi-function exercise apparatus may be provisioned with storage locations to maintain weights and other accessories with the apparatus, to equip the multi-function exercise with the necessary weights and accessories for performing a full body exercise regimen.

Non-limiting embodiments of a multi-function exercise apparatus 10 according to aspects of the present invention are shown in reference to the drawings of FIGS. 1-11. The apparatus is configured as a bench that includes a cushion assembly 12 having a plurality of cushion segments. The cushion assembly 12 is carried on an articulating frame assembly 14 that allows segments of the cushion assembly 12 to be reconfigured for a plurality of fitness exercises. The articulating frame assembly 14 is supported by a base 16. The base assembly 16 includes a plurality of storage fixtures that are configurable to retain a plurality of weights and exercise accessories for conducting a desired fitness regimen.

The cushion assembly 12 includes a first cushion segment 12*a* located at a front facing end of the apparatus 10, a second cushion segment 12*b* located at an intermediate position of the apparatus 10, and a third cushion segment 12*c* that is positioned at an aft end of the apparatus 10.

The articulating frame assembly 14 permits the cushion assembly 12 to be raised on either of a partial tilting configuration and a full tilting configuration. As seen in reference to FIG. 3 and FIG. 10, in the partial tilting configuration, the first cushion segment 12*a* is maintained in a flat orientation and supported on the base assembly 16 by an exterior frame element 14*a*. In this configuration, the first cushion segment 12*a* may serve as a seat. Each of the second cushion segment 12*b*, and the third cushion segment 12*c* are carried on an interior frame element 14*b*. The interior frame element 14*b* is configured to articulate about the exterior frame element 14*a* in an arching movement. In this configuration, the first cushion segment 12*a* serves as a seat, while the second cushion segment 12*b* and the third cushion segment 12*c* form a backrest.

The interior frame element 14*b* is supported by a first support arm 14*c* pivotally connected at a first end to the interior frame element 14*b*. A second end of the first support arm 14*c* may be connected with a first plurality of indexed engagement points 16*g* defined across a top surface 16*i* of the base 16. Selection of a desired indexed engagement point 16*g*, best seen in reference to FIG. 11, permits the inner frame element 14*b* to be elevated to a desired vertical angle between 0 and about 80 degrees. Selection of the desired vertical elevation would depend upon the desired exercised to be performed, by way of non-limiting example, a supine press, an inclined press, and an overhead press configuration.

Figure 4:
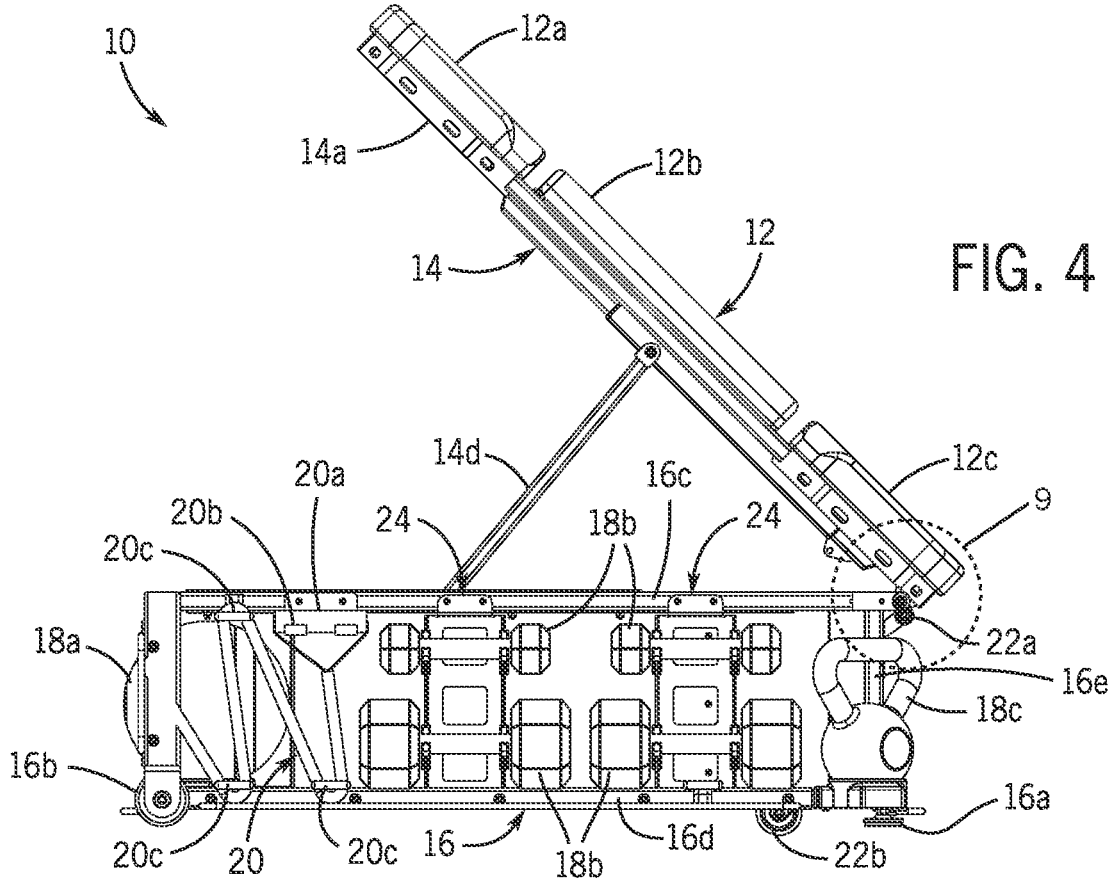
FIG. 4 is a side elevation view showing the cushion in the second inclined position.
Figure 6:
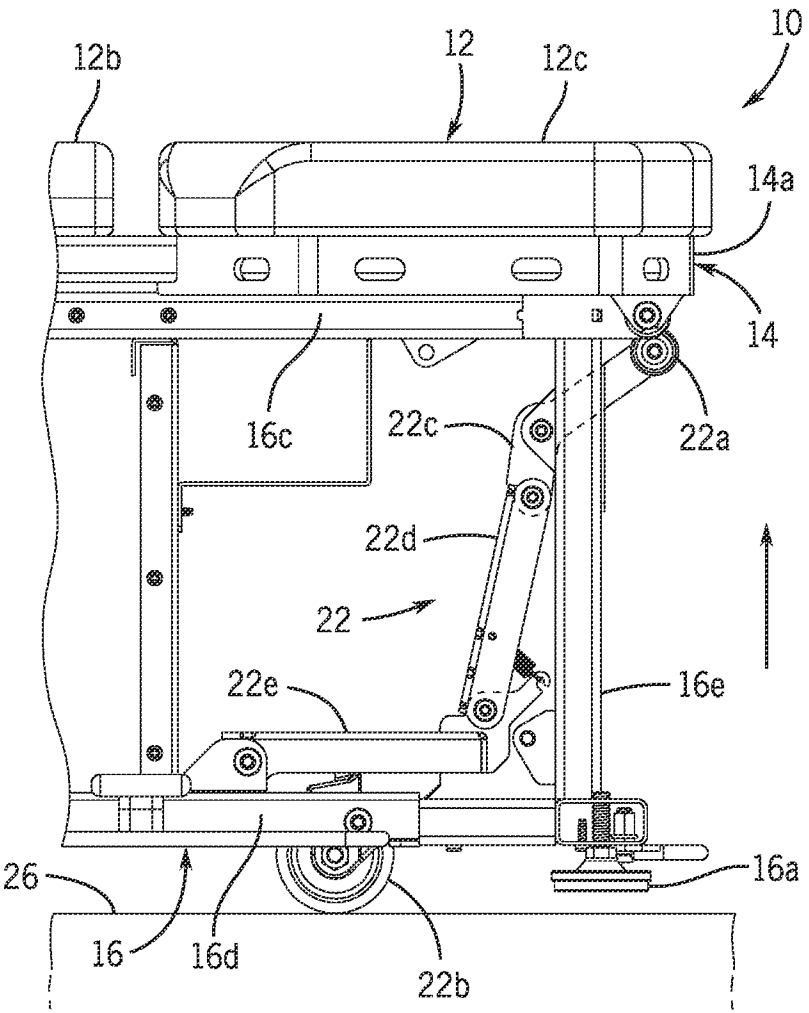
FIG. 6 is a detail side elevation view showing the caster wheel in the engaged position.
Figure 5:
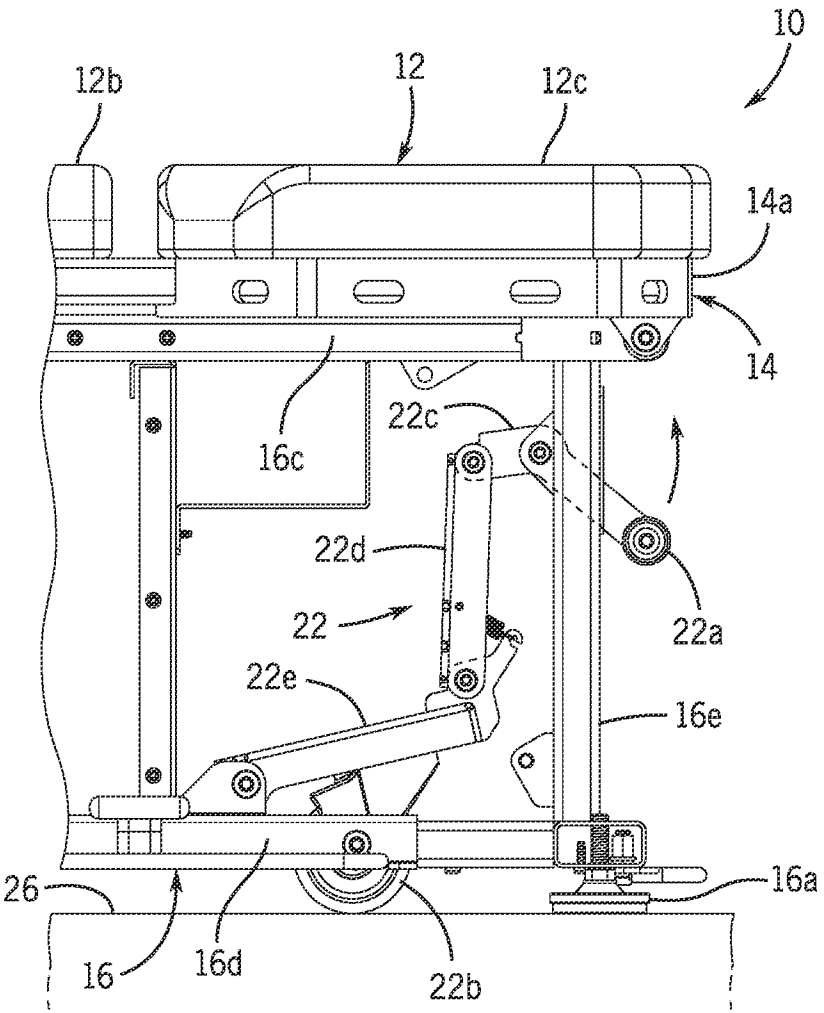
FIG. 5 is a detail side elevation view showing a caster wheel in the disengaged position.
Figure 12:
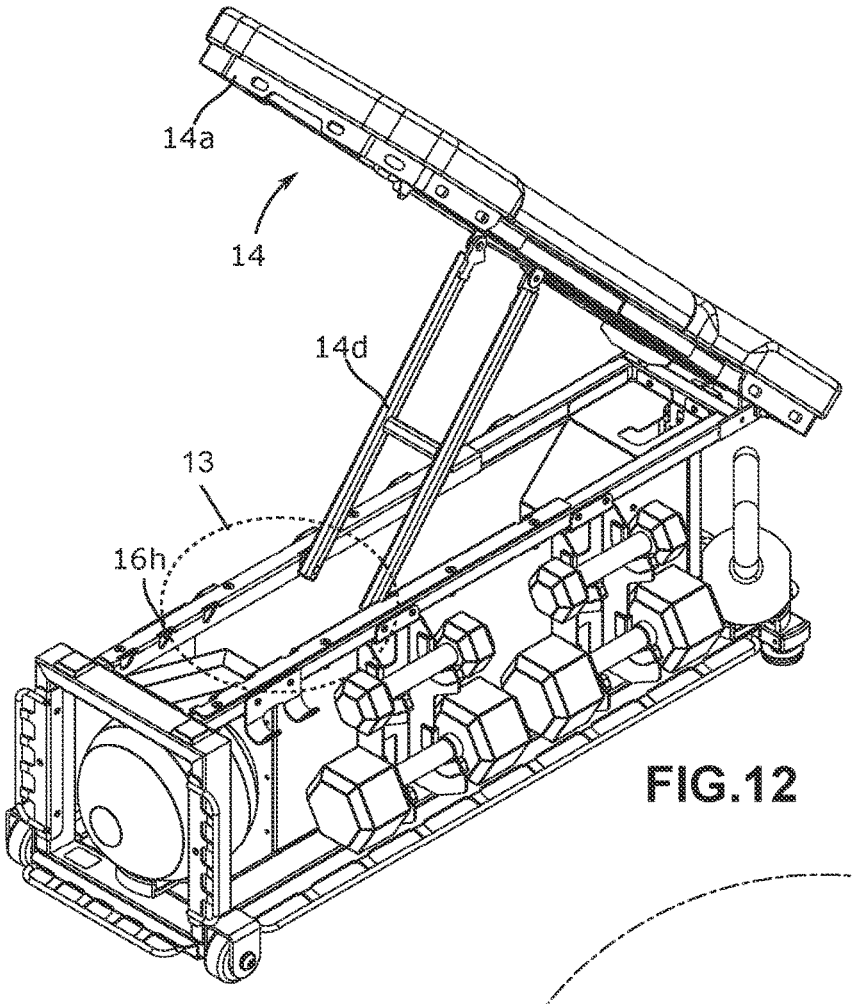
FIG. 12 is a rear perspective view showing the cushion in the full tilting configuration.

As seen in reference to FIG. 4 and FIG. 12, the apparatus 10 is shown in the full tilting configuration. In this configuration, the exterior frame element 14*a* is configured to support each of the first cushion segment 12*a*, the second cushion segment 12*b*, and the third cushion segment 12*c* in a linear orientation. The cushion assembly 12 and the frame assembly 14 pivot in an arc about an aft end of the base assembly 16.

Figure 13:
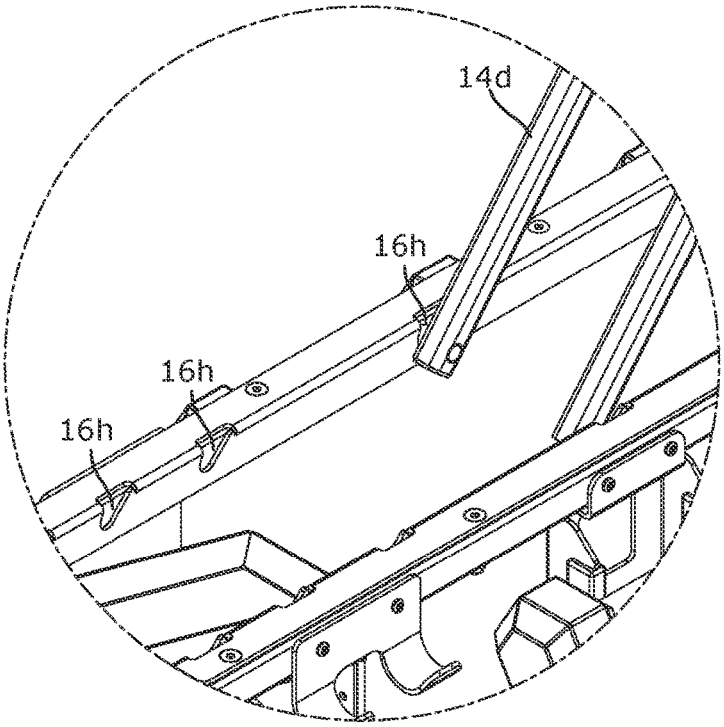
FIG. 13 is a detail perspective view taken from area 13 of FIG. 12 showing the second indexed engagement points spaced along the upper rail.

In this configuration, the exterior frame element 14*a* is supported by a second support arm 14*d*. A first end of the second support arm 14*d* is pivotally attached to the exterior frame element 14*a*. A second end of the second support arm 14*d* may be connected with a second plurality of indexed engagement points 16*h* that are defined in a spaced apart relation along the upper rail 16*c* as shown in FIG. 13. Selection of a desired one of the second indexed engagement point 16*h* permits the exterior frame element 14*b* to be supported in an elevated condition at a desired vertical angle between 0 and 80 degrees. In this configuration, the apparatus 10 may be used, for example, to perform a standing inclined press, a standing, overhead press, or inclined rowing exercises.

The base assembly 16 includes an upper rail 16*c*, a lower rail 16*d*, and a plurality of upright frame rails 16*e*, that are joined as a rectangular box configuration. The base assembly 16 may also include a plurality of feet 16*a*. The plurality of feet 16*a* may be vertically adjustable to ensure that the base assembly 16 is evenly supported by a floor surface 26 so that the apparatus 16 does not wobble or present an unstable exercise platform.

Figure 2:
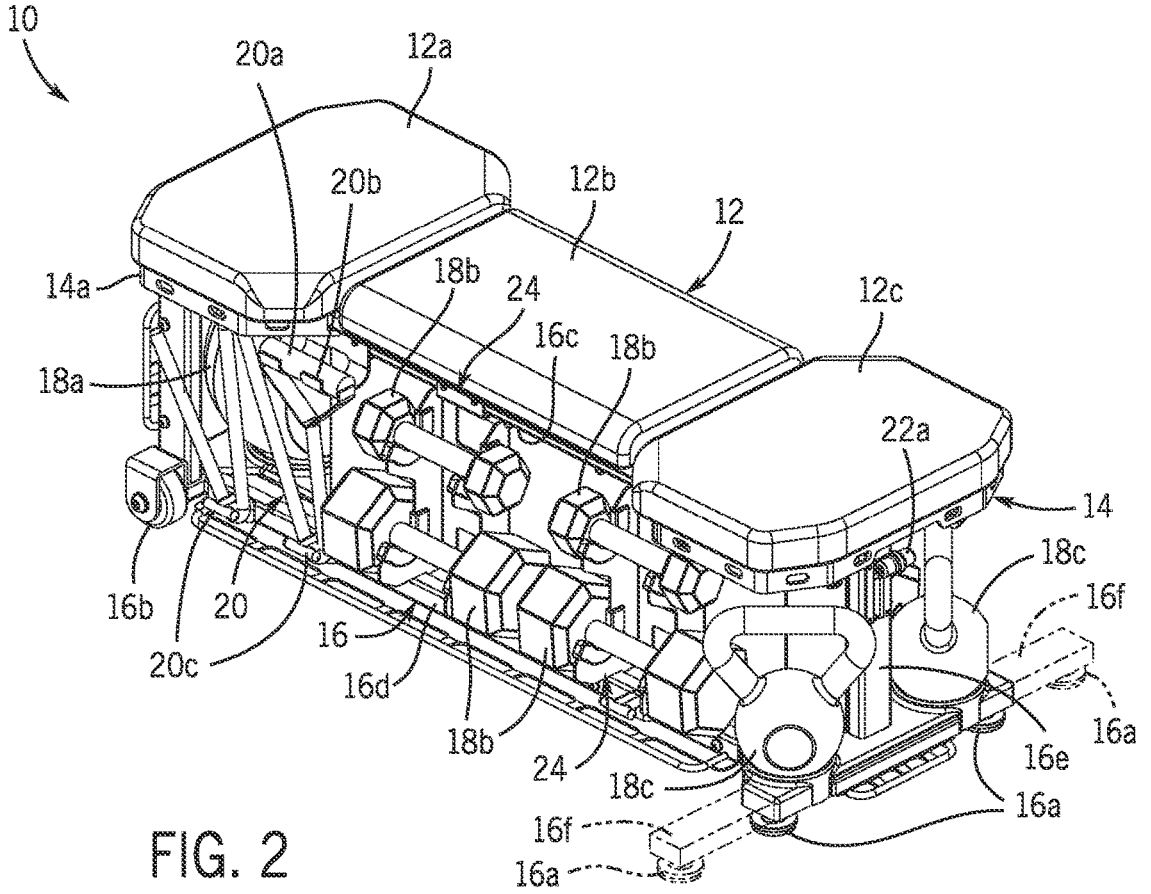
FIG. 2 is a rear perspective view of the multi-function exercise apparatus showing the cushion in the flat position.

Each of the plurality of feet 16*a* may be carried by a selectively extensible foot support 16*f* as shown in FIG. 2. The extensible foot support 16*f* is moveable between a retracted position and an extended position wherein the feet 16*a* and extensible foot support 16*f* support the bench assembly as an out rigging to provide improved vertical stability for the apparatus 10, particularly when the cushion assembly 12 and frame assembly are configured in an elevated condition.

The base assembly 16 may also include a plurality of wheels 16*b* disposed at an opposite end from the plurality of feet 16*a* as shown in FIG. 1. In the non-limiting embodiment shown, the plurality of wheels 16*b* are attached to the front end of the base assembly. With the plurality of feet 16*a* properly positioned in contact with the supporting floor surface 26, the apparatus is prevented from rolling.

The base assembly 16 also includes a caster assembly 22. As best seen in reference to FIGS. 5 and 6, the caster assembly 22 is operable to selectively raise and lower a swivel mounted caster 22*b* from a bottom of the base assembly 16. In the lowered position the caster 22*b* elevates the plurality of feet 16*a* from contact with the supporting floor surface 26. In this position, the apparatus 10 may be readily positioned to a desired orientation. Swiveling of the swivel mounted caster 22*b* permits the apparatus 10 to be rotated within a close turn radius to limit the area of floor space to turn the apparatus 10 to the desired orientation.

The caster assembly includes a handle 22*a* that is disposed between the upright frame rails 16*e* at the foot end of the base assembly 16. The handle 22*a* is coupled with the swivel mounted caster 22*b* via a plurality of linkages to provide a mechanical advantage to selectively raise and lower the frame assembly 16. The mechanical advantage is particularly useful when the base assembly 16 carries a plurality of weights and exercise accessories. In the non-limiting embodiment shown, the plurality of linkages include a first linkage 22*c* disposed at an end of the handle 22*a* distal from a pivot about which the handle 22*a* operates. A second linkage 22*d* extends substantially vertically to a bottom end of the base assembly 16. The second linkage 22*d* is pivotally coupled to a distal end of a third linkage 22*e*, with a proximal end of the third linkage 22*e* pivotally coupled to the bottom rail 16*d* of the base assembly 16. The swivel mounted caster 22*b* is carried by an intermediate portion of the third linkage 22*e*.

The handle 22*a* and plurality of linkages are configured such that an upward lifting of the handle 22*a* extends the swivel mounted caster 22*b* such that the base assembly 16 is elevated from the supporting ground surface. This orientation provides the user better leverage to "lift" the apparatus 10 with a lifting of the handle 22*a*. Once the apparatus is placed in the desired orientation, the user may lower the handle 22*a* to retract the swivel mounted caster 22*b*, such that the base assembly 16 is supported on the plurality of feet 16*a*.

The frame assembly 16 may also be configured with a plurality of weight and accessory supports and attachment points as shown in FIG. 1. The weights and accessories may include a weighted ball 18*a*, a plurality of dumbbells 18*b*, one or more kettle bells 18*c*, and one or more elastic resistance bands 20.

The weighted ball 18*a* may be conveniently stowed on a plate 24*g* carried by the lower rails 16*b*, as seen in FIG. 1. The plate 24*g* may have a depression to retain the weighted ball 18*a*, the depression having a sufficient depth to prevent the weighted ball 18*a* from rolling off the apparatus 10 when the apparatus is being used for exercises or being repositioned.

Figure 7:
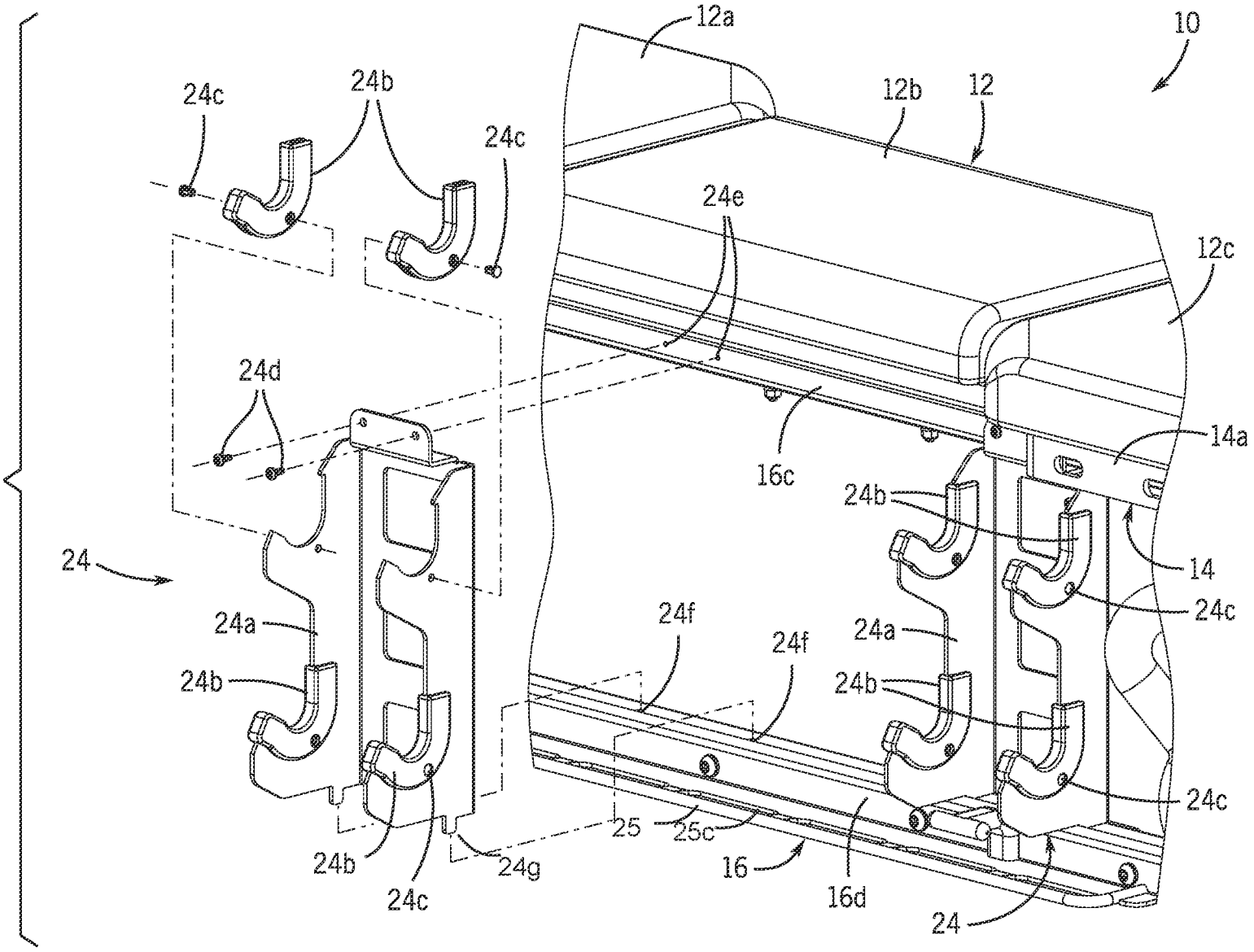
FIG. 7 is a detail exploded perspective view of an accessory mount.

An accessory support 24 as shown in FIG. 7 is provided to carry the plurality of dumbbells 18*b* on the base assembly. The accessory support 24 is attached between the upper rail 16*c* and the lower rail 16*d* of the base assembly 16 via one or more fasteners 24*d* received in apertures 24*e* in the upper rail 16*c*. The accessory support 24 has at least one pair of upstanding arcuate arms providing a notch in which to retain a handle of the dumbbell 18*b*. The notch may have a cushion 24*b* to cushion a contact between the dumbbell 18*b* and the accessory support 24 when the dumbbell 18*b* is placed or removed in the accessory support 24.

As will be appreciated, the at least one pair of upstanding arms may include a plurality of upstanding arms disposed in a spaced apart configuration, depending on a size of the dumbbell 18*b* carried thereon. The accessory support 24 may have a pin 24*g* protruding from a bottom end of thereof. The pins 24*g* are engageable with a plurality of apertures 24*f* defined in the lower rail 16*d*.

Figure 3:
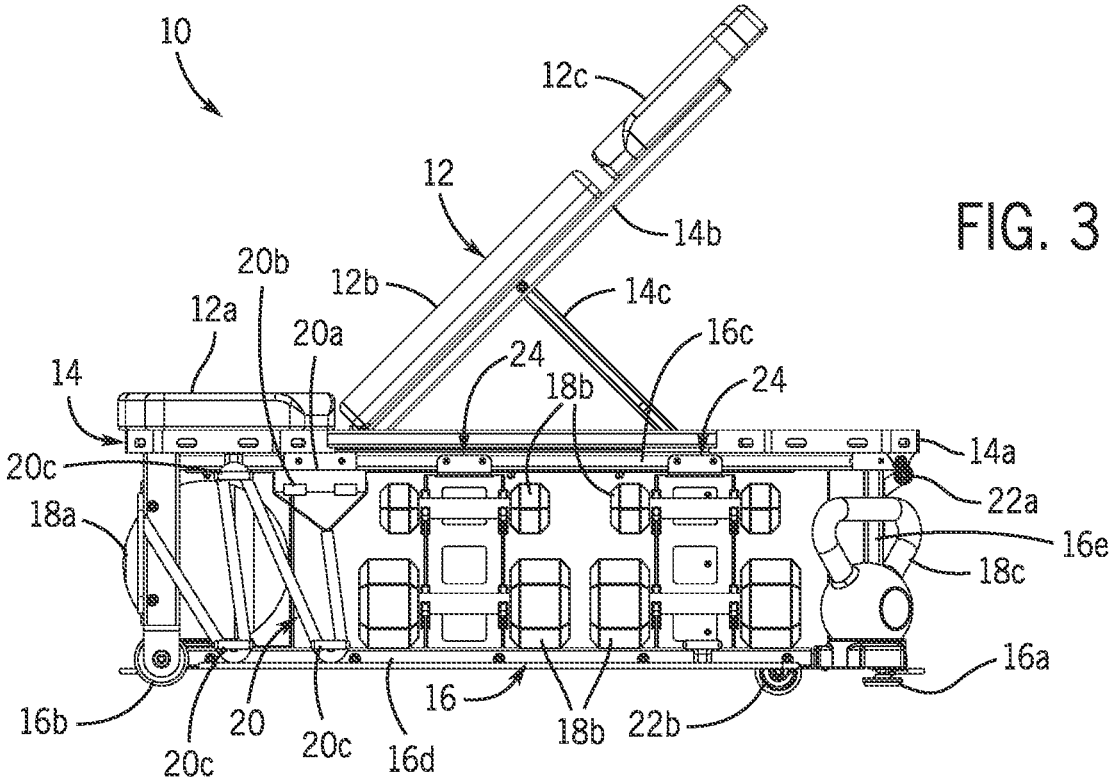
FIG. 3 is a side elevation view showing the cushion in the first inclined position.

The one or more elastic resistance bands 20 include a handle 20*a* at a distal end and a coupling at a proximal end as shown generally in FIGS. 3-4. The elastic resistance bands 20 may be coupled to the apparatus 16 at various locations to allow the user to conduct various exercises. By way of non-limiting example, the resistance band 20 may be coupled to a plurality of cleats 20*c* that are coupled to one or more of the upper rails 16*c* and the lower rail 16*d*. A plurality of cleats 20*c* may be disposed in a spaced apart relation along a longitudinal length of the upper rail 16*c* and the lower rail 16*d*. The plurality of cleats 20*c* provide the user a means of varying the resistance of the elastic resistance band 20 or a placement of the elastic resistance band 20 relative to the apparatus 10 to provide for a wide range of resistance band exercises. As best seen in reference to FIG. 1, the one or more elastic resistance bands 20 may be conveniently stowed by suspending the band 20 from the plurality of cleats 20*c*.

The base assembly 16 may also include one or more modular resistance rails 25 such as seen in reference to FIGS. 1 and 7, attached to one or more of the upright rails 16, upper rail 16*c*, or the lower rail 16*d*. The one or more modular resistance rails 25 include a plurality of slots 25*c* disposed in a spaced apart relation along a length of the modular resistance rail 25. The plurality of slots 25 are adapted to attach the distal end of the elastic resistance band 20 to the apparatus 10.

Figure 8:
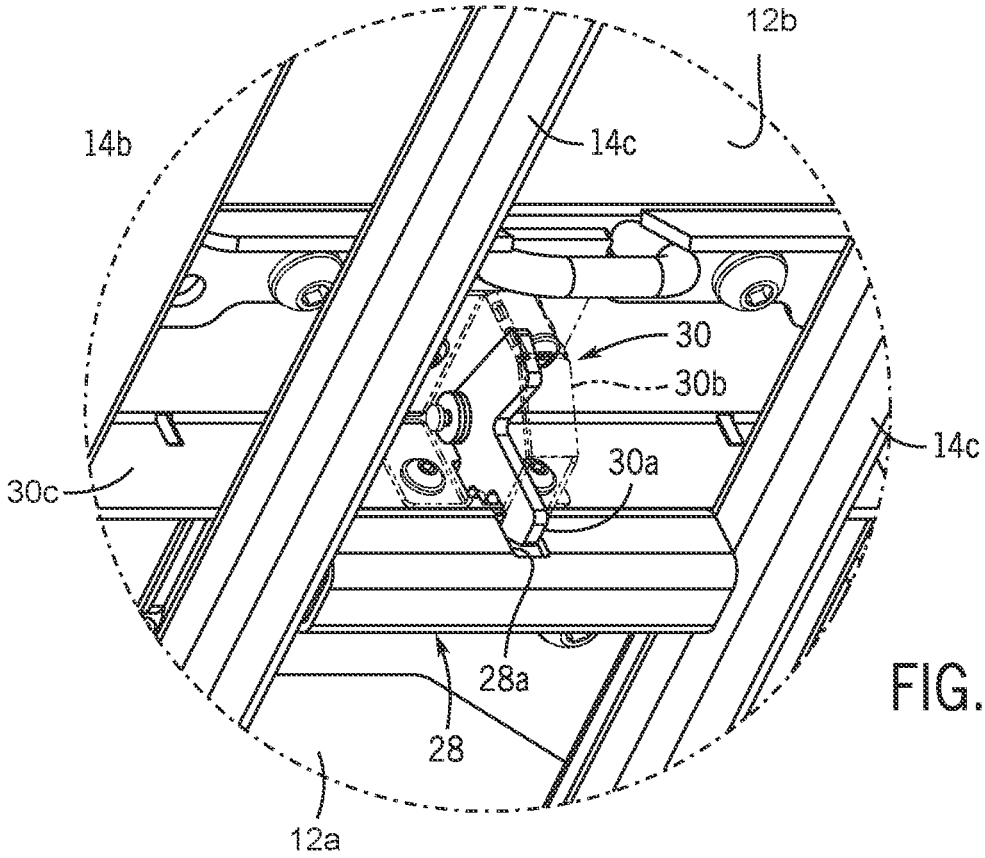
FIG. 8 is a detail perspective view of a first interlock assembly with a latch to retain the first support arm 14*d* (support arm).
Figure 9:
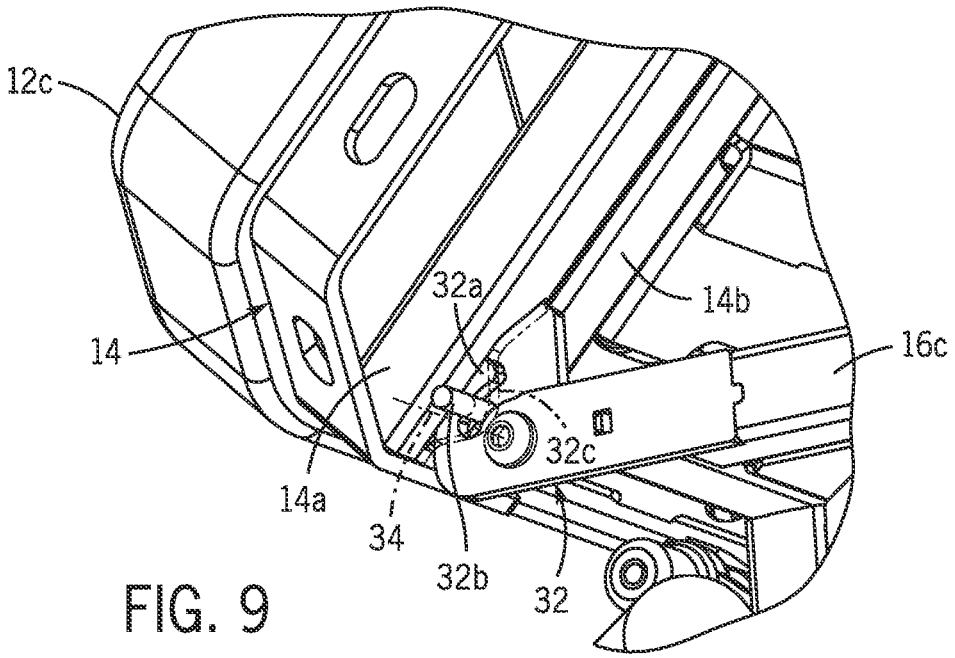
FIG. 9 is a detail perspective view taken from area 9 of FIG. 4. of the underside of the cushion assembly showing the hook.
Figure 10:
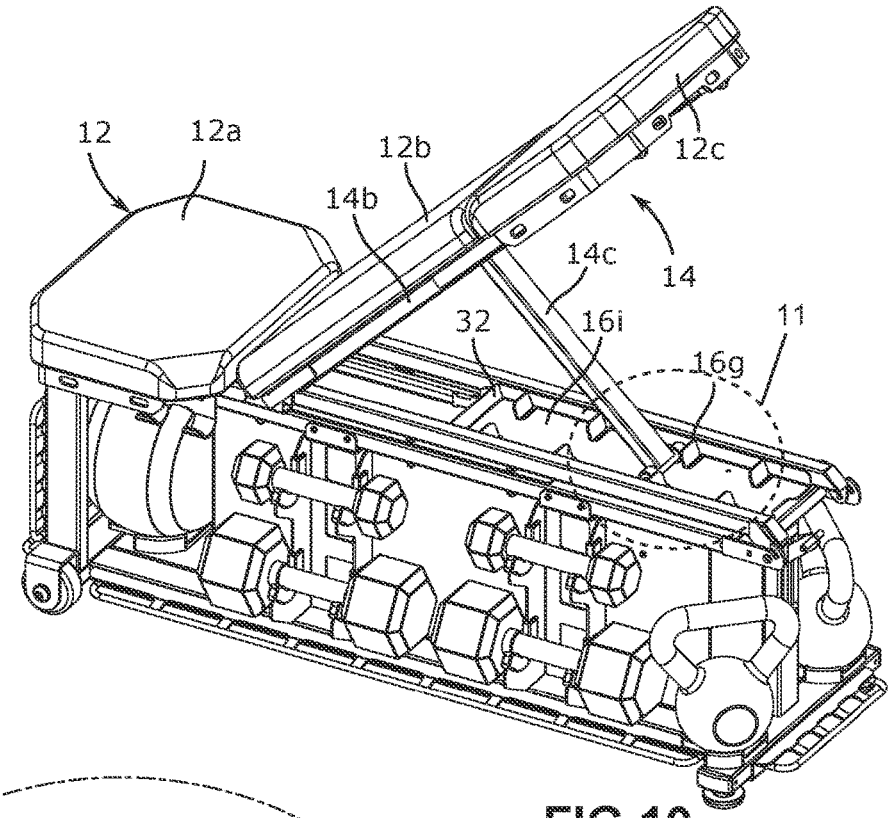
FIG. 10 is a top rear perspective view showing the multi-function exercise apparatus in a partial tilting configuration.
Figure 11:
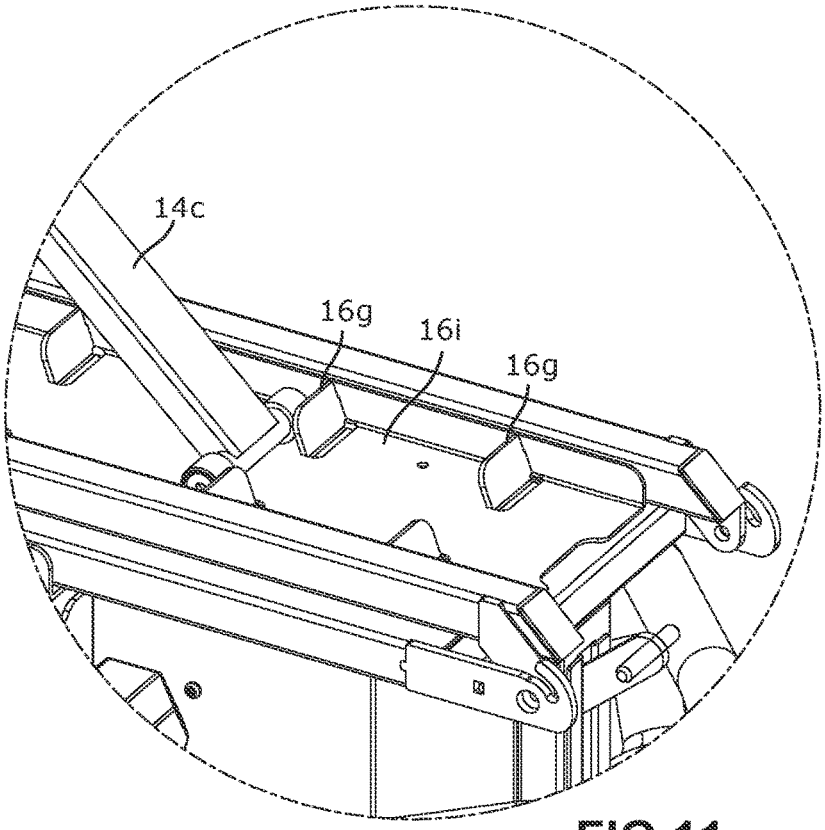
FIG. 11 is a detail perspective view taken from area 11 of FIG. 10.

As best seen in reference to the detail views of FIGS. 8 and 9, the frame assembly 14 may also be provided with interlock features to prevent the user from positioning the articulating frame assembly 14 in an unsafe condition. A forward interlock, shown in FIG. 8, includes latch assembly 30. The latch assembly 30 is pivotally coupled to a plate 30*c* extending between the exterior frame elements 14*a*, proximal to the first cushion segment 12*a*. An actuating flange extends laterally across the exterior frame element 14*a* proximal to an inboard end of the first cushion segment 12*a*. A cross member 28 extends laterally across the second support arm 14*d*. The cross member 28 has an aperture 28*a*. A pin 30*a* on the latch 30 is selectively engageable with the aperture 28*a*. When the exterior frame element 14*a* is moved to the lowered flat condition, the actuating flange engages with the latch 30 to disengage the pin 30*a* from the aperture 28*a*.

When the interior frame element 14*b* is raised, to form the seatback with the second cushion segment 12*b* and the third cushion segment 12*c*, the second support arm 14*d* is retained by engagement of the pin 30*a* with the aperture 28*a*, so that the second support arm 14*d* is inoperative for engagement with the indexed engagement points on the base 16 to prevent the outer frame 14*a* from being supported in an elevated condition while the interior frame 14*b* is also supported in an elevated condition.

The second interlock is shown in reference to FIG. 9. The second interlock includes a hook assembly 32 that is attached at the distal end of the upper rail 16*c* proximal to the pivot axis 34 of the outer frame 14*a* with the upper rail 16*c*. The hook assembly 32 includes an arcuate finger 32*a* that defines an arcuate slot 32*c*. A pin 32*b* laterally extends from a flange extending from the interior frame element 14*b*. The arcuate slot 32*c* is dimensioned such that with the exterior frame 14*a* in the lowered position, the pin 32*b* is withdrawn from the arcuate slot 32*c*, permitting the interior frame 14*b* to be elevated.

When the exterior frame element 14*a* is in the elevated position the pin 32*b* is received within the arcuate slot 32*c*. With the pin 32*b* received within the arcuate slot 32*c*, movement of the interior frame element 14*b* is prevented by contact of the pin 32*b* with the arcuate finger 32*a*.

It should be understood, of course, that the foregoing relates to exemplary embodiments of the invention and that modifications may be made without departing from the spirit and scope of the invention as set forth in the following claims.

What is claimed is:

1. A multi-function exercise apparatus, comprising:

a base assembly supporting an articulating frame assembly;

the articulating frame assembly comprising an exterior frame element pivotally coupled to a first end of the base assembly, the exterior frame element operable for a full tilting configuration of the multi-function exercise apparatus, and an interior frame element pivotally coupled to the exterior frame element, the interior frame element operable for a partial tilting configuration of the multi-function exercise apparatus;

a cushion assembly carried on the articulating frame assembly;

a first support arm having a first end and a second end, the first end of the first support arm pivotally coupled to the interior frame element, and the second end of the first support arm engageable with a first plurality of indexed engagement points defined in a spaced apart relation across a top of the base assembly; and a second support arm having a first end and a second end, the first end of the second support arm pivotally coupled to the exterior frame element, and the second end of the second support arm engageable with a second plurality of indexed engagement points defined in a spaced apart relation along a top rail of the base assembly.

2. The multi-function exercise apparatus of claim 1, wherein in the full tilting configuration, the cushion assembly is maintained in a linear alignment with the exterior frame element.

3. The multi-function exercise apparatus of claim 1, wherein in the partial tilting configuration, a first cushion of the cushion assembly is maintained in a flat condition with the exterior frame element, defining a seat, and at least one other cushion of the cushion assembly is carried by the interior frame element, defining a backrest, when the interior frame element is raised in the partial tilting configuration.

4. The multi-function exercise apparatus of claim 1, wherein the exterior frame element is movable in a first arc in the full tilting configuration and the interior frame element is movable in a second arc, opposite the first arc, when operated in the partial tilting configuration.

5. The multi-function exercise apparatus of claim 1, wherein, when engaged with a selected one of the first plurality of indexed engagement points, the interior frame element is supported at a selected partial tilting angle relative to the exterior frame element.

6. The multi-function exercise apparatus of claim 1, wherein, when engaged with a selected one of the second plurality of indexed engagement points, the exterior frame element is supported at a selected full tilting angle relative to the base assembly.

7. The multi-function exercise apparatus of claim 1, further comprising:

a pair of feet attached to a front end of the base assembly;

a pair of wheels attached to a rear end of the base assembly, opposite the pair of feet; and a caster assembly mechanically coupled to the front end of the base assembly, the caster assembly operable to selectively position the caster assembly between a raised position and a lowered position, wherein in the lowered position, the base assembly is movable on the pair of wheels and the caster assembly, and in the raised position, the base assembly is supported by the pair of feet.

8. The multi-function exercise apparatus of claim 7, further comprising:

a handle disposed at the front end of the base assembly; and a plurality of linkages interconnecting the handle with the caster assembly, wherein operation of the handle positions the caster assembly between the raised position and the lowered position.

9. The multi-function exercise apparatus of claim 8, where a lifting of the handle operates the caster assembly to the lowered position.

10. A multi-function exercise apparatus, comprising:

a base assembly;

an exterior frame element pivotally coupled to a front end of the base assembly, the exterior frame element operable for a full tilting configuration of the multi-function exercise apparatus;

an interior frame element pivotally coupled to the exterior frame element, the interior frame element operable for a partial tilting configuration of the multi-function exercise apparatus;

at least one cushion of a cushion assembly is carried on each of the exterior frame element and the interior frame element;

a caster assembly mechanically coupled to the front end of the base assembly;

a pair of wheels attached to a rear end of the base assembly; and the caster assembly operable to selectively position the base assembly between a lowered position and a raised position, wherein in the raised position, the base assembly is movable on the pair of wheels and the caster assembly.

11. The multi-function exercise apparatus of claim 10, further comprising:

a handle coupled at the front end of the base assembly; and a plurality of linkages interconnecting the handle with the caster assembly, wherein operation of the handle selectively positions the caster assembly between the raised position and the lowered position.

12. The multi-function exercise apparatus of claim 11, where a lifting of the handle operates the caster assembly to support the base assembly in the raised position.

13. The multi-function exercise apparatus of claim 10, wherein in the partial tilting configuration, a first cushion of the cushion assembly is maintained in a flat condition with the exterior frame element, defining a seat, and at least one other cushion of the cushion assembly is carried by the interior frame element, defining a backrest when the interior frame element is raised in the partial tilting configuration.

14. The multi-function exercise apparatus of claim 10, wherein the exterior frame element is movable in a first arc in the full tilting configuration and the interior frame element is movable in a second arc, opposite the first arc, in the partial tilting configuration.

15. The multi-function exercise apparatus of claim 10, further comprising:

a first support arm having a first end and a second end, the first end of the first support arm pivotally coupled to the interior frame element, and the second end of the first support arm engageable with a first plurality of indexed engagement points defined in a spaced apart relation across a top surface of the base assembly; and a second support arm having a first end and a second end, the first end of the second support arm pivotally coupled to the exterior frame element, and the second end of the second support arm engageable with a second plurality of indexed engagement points defined in a spaced apart relation along a top rail of the base assembly.

16. The multi-function exercise apparatus of claim 15, wherein, when engaged with a selected one of the first plurality of indexed engagement points, the interior frame element is supported at a selected partial tilting angle relative to the exterior frame element; and when engaged with a selected one of the second plurality of indexed engagement points, the exterior frame element is supported at a selected full tilting angle relative to the base assembly.

17. A multi-function exercise apparatus, comprising:

a base assembly;

an exterior frame element pivotally coupled to a front end of the base assembly, the exterior frame element operable for a full tilting configuration of the multi-function exercise apparatus about a first arc; and an interior frame element pivotally coupled to the exterior frame element, the interior frame element operable for a partial tilting configuration of the multi-function exercise apparatus about a second arc opposite the first arc; and a first cushion carried on the exterior frame element and at least one second cushion carried on the interior frame element;

a first support arm having a first end and a second end, the first end of the first support arm pivotally coupled to the interior frame element, and the second end of the first support arm engageable with a first plurality of indexed engagement points defined in a spaced apart relation across a top of the base assembly; and a second support arm having a first end and a second end, the first end of the second support arm pivotally coupled to the exterior frame element, and the second end of the second support arm engageable with a second plurality of indexed engagement points defined in a spaced apart relation along a top rail of the base assembly.

* * * * *